US008047647B2

(12) United States Patent
Okuno et al.

(10) Patent No.: US 8,047,647 B2
(45) Date of Patent: Nov. 1, 2011

(54) FLUID EJECTING APPARATUS

(75) Inventors: Tokujiro Okuno, Matsumoto (JP); Kazuhiro Hashii, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 451 days.

(21) Appl. No.: 12/406,411

(22) Filed: Mar. 18, 2009

(65) Prior Publication Data

US 2009/0237480 A1 Sep. 24, 2009

(30) Foreign Application Priority Data

Mar. 19, 2008 (JP) ..... 2008-071509
Nov. 12, 2008 (JP) ..... 2008-289912

(51) Int. Cl.
*B41J 2/01* (2006.01)

(52) U.S. Cl. ..... 347/104

(58) Field of Classification Search ..... 347/16, 347/101, 104, 105
See application file for complete search history.

(56) References Cited

U.S. PATENT DOCUMENTS 5,326,011 A * 7/1994 Mager et al. ..... 226/181
5,874,979 A * 2/1999 Ohyama ..... 347/104
6,659,603 B2 * 12/2003 Kida et al. ..... 347/104
7,232,269 B2 * 6/2007 Ohyama ..... 400/642
7,334,890 B2 * 2/2008 Nakamura ..... 347/104
7,815,181 B2 * 10/2010 Okuno ..... 271/3.14
2004/0188927 A1 * 9/2004 Tanabe ..... 271/207

FOREIGN PATENT DOCUMENTS

JP 09-048161 2/1997
JP 2002-226077 8/2002
JP 2006-188323 7/2006
JP 2006-232500 9/2006

* cited by examiner

*Primary Examiner* — Daniel Petkovsek
(74) *Attorney, Agent, or Firm* — Workman Nydegger

(57) ABSTRACT

A fluid ejecting apparatus includes a supporting member that supports a fluid ejection target medium; a fluid ejecting head that is provided opposite to the supporting member so as to eject fluid toward the supporting member; and a medium ejecting unit that ejects the medium in a first direction while holding the medium in such a manner that the medium is supported by the supporting member. The medium ejecting unit includes a driving roller that is provided at the supporting-member side and is in contact with the medium from the supporting-member side when the medium ejecting unit holds the medium, and a driven roller that is provided at the fluid-ejecting-head side and is in contact with the medium from the fluid-ejecting-head side when the medium ejecting unit holds the medium.

7 Claims, 6 Drawing Sheets

FLUID EJECTING APPARATUS

BACKGROUND

1. Technical Field

The present invention relates to a fluid ejecting apparatus.

2. Related Art

An ink jet type recording apparatus is known as an example of a variety of fluid ejecting apparatuses that eject fluid onto a fluid ejection target medium. Some fluid-ejecting type recording apparatuses of the related art eject fluid as follows. A fluid-ejecting type recording apparatus is provided with a platen (supporting member) that supports a sheet of recording paper or the like (fluid ejection target medium) from thereunder, a fluid ejecting head that ejects fluid, and a pair of rollers that forms a nip therebetween. While transporting a sheet of recording paper by means of the pair of rollers, the fluid-ejecting type recording apparatus ejects fluid such as ink onto the sheet of recording paper that is supported on the platen from the fluid ejecting head.

In the operation of the related-art fluid-ejecting type recording apparatus, it could be difficult to make a fluid ejection target medium supported on the platen in a stable manner depending on the position of the fluid ejection target medium. For example, the fluid ejection target medium could be supported unstably on the platen with a part of the fluid ejection target medium being curved/curled toward the ejecting-head side. When the fluid ejection target medium is unstably supported, the distance from the surface of the fluid ejecting head to the surface of the fluid ejection target medium varies, which means that the ejection distance of the fluid also changes. Because of such a change in the ejection distance of the fluid, it is difficult to make ejected fluid such as ink drops land on desired positions on the surface of the fluid ejection target medium, which results in poor fluid-ejection recording performance.

In an effort to provide a solution to such a problem, a fluid-ejecting type recording apparatus that is provided with an urging member that urges a fluid ejection target medium has been proposed in the art. An example of such a configuration is described in JP-A-9-48161. In the proposed configuration, a fluid ejection target medium is transported at a certain angle with respect to the surface of a platen. Accordingly, the fluid ejection target medium is urged onto the surface of the platen. By this means, it is possible to prevent a paper-platen gap from being formed between the fluid ejection target medium and the platen and to support the fluid ejection target medium on the platen in a stable manner.

However, the configuration that includes the urging member explained above has the following disadvantage. Although it is possible to support a fluid ejection target medium on the platen where the urging member is provided and in the neighborhood thereof, it is difficult to support the fluid ejection target medium on the platen in a stable manner at a distant regional part thereof that is relatively remote from the urging member due to a decrease in the strength of an urging force thereat. These days, since the length of a fluid ejecting head when viewed in the direction of the transportation of a fluid ejection target medium is increasing, the length of the landing area of fluid when viewed in the direction of the transportation of the fluid ejection target medium is also increasing. For this reason, it is getting more and more difficult to make the entire surface of the fluid landing area of a fluid ejection target medium supported on the surface of a platen in a stable manner.

SUMMARY

An advantage of some aspects of the invention is to provide a fluid ejecting apparatus that is capable of making a fluid ejection target medium supported on the supporting member in a stable manner.

In order to address the above-identified problem without any limitation thereto, a fluid ejecting apparatus according to an aspect of the invention includes: a supporting member that supports a fluid ejection target medium; a fluid ejecting head that is provided opposite to the supporting member so as to eject fluid toward the supporting member; and a medium ejecting section that ejects the medium in a first direction while holding the medium in such a manner that the medium is supported by the supporting member, the medium ejecting section including a driving roller that is provided at the supporting-member side and is in contact with the medium from the supporting-member side when the medium ejecting section holds the medium, and a driven roller that is provided at the fluid-ejecting-head side and is in contact with the medium from the fluid-ejecting-head side when the medium ejecting section holds the medium, wherein the driven roller protrudes outward in such a manner that an end part provided at each side of the driven roller when viewed in a second direction lies at a relatively outside end position in comparison with the end position of an end part provided at each side of the driving roller when viewed in the second direction; and the diameter of the protruding part of the driven roller is larger than that of the other part of the driven roller.

More specifically, in the configuration of a fluid ejecting apparatus including a supporting member that supports a fluid ejection target medium; a fluid ejecting head that is provided opposite to the supporting member so as to eject fluid toward the supporting member; and a medium ejecting section that ejects the medium in a first direction while holding the medium in such a manner that the medium is supported by the supporting member, the medium ejecting section including a driving roller that is provided at the supporting-member side and is in contact with the medium from the supporting-member side when the medium ejecting section holds the medium, and a driven roller that is provided at the fluid-ejecting-head side and is in contact with the medium from the fluid-ejecting-head side when the medium ejecting section holds the medium, wherein the driven roller protrudes outward in such a manner that an end part provided at each side of the driven roller when viewed in a second direction lies at a relatively outside end position in comparison with the end position of an end part provided at each side of the driving roller when viewed in the second direction; and the diameter of the protruding part of the driven roller is larger than that of the other part of the driven roller, it is preferable that the driven roller and the driving roller should be provided at such relative positions that at least a part of the driven roller overlaps at least a part of the driving roller when viewed along the second direction.

In the configuration of a fluid ejecting apparatus according to an aspect of the invention, the medium ejecting section, which transports a medium in the first direction while holding the medium, includes a driving roller that is provided at the supporting-member side and is in contact with the medium from the supporting-member side when the medium ejecting section holds the medium, and a driven roller that is provided at the fluid-ejecting-head side and is in contact with the medium from the fluid-ejecting-head side when the medium ejecting section holds the medium. In such a configuration of a fluid ejecting apparatus according to an aspect of the invention, the driven roller protrudes outward in such a manner that an end part provided at each side of the driven roller when viewed in a second direction lies at a relatively outside end position in comparison with the end position of an end part provided at each side of the driving roller when viewed in the second direction. In addition, the diameter of the protruding part of the driven roller is larger than that of the other part of the driven roller. Since a fluid ejecting apparatus according to an aspect of the invention has the configuration explained above, the medium that is held by the medium ejecting section is put into a curved form along the surface of the driven roller. Since the medium is put into a curved form, it is possible to increase the stiffness of the medium in the curve projection direction, which results in the enhanced shape stability of the medium in this direction. By this means, it is possible to make the fluid ejection target medium supported on the supporting member in a stable manner.

In addition, since the driven roller and the driving roller are provided at such relative positions that at least a part of the driven roller overlaps at least a part of the driving roller when viewed along the second direction in a preferred configuration thereof, it is possible to put the medium into a curved form with greater reliability. Thus, it is possible to increase the stiffness of the medium without fault.

In the configuration of a fluid ejecting apparatus according to an aspect of the invention described above, it is preferable that the medium ejecting section should include a plurality of sections that are arrayed in the second direction. In other words, it is preferable that the plurality of medium ejecting sections should be arrayed in the second direction. With such a preferred configuration, since the plurality of medium ejecting sections is arrayed in the second direction, which is orthogonal to the direction of the transportation of a fluid ejection target medium, it is possible to form curves in the medium along the second direction. The plurality of curves makes it possible to further increase the stiffness of the medium, thereby enhancing the shape stability of the medium.

In the preferred configuration of a fluid ejecting apparatus described above, it is further preferable that the plurality of medium ejecting sections should be arrayed at substantially regular intervals. With such a preferred configuration, since the plurality of medium ejecting sections is arrayed at substantially regular intervals, it is possible to form the plurality of curves in a fluid ejection target medium at substantially regular intervals when viewed in the second direction. Therefore, it is possible to achieve uniform stiffness of the medium along the second direction.

In the configuration of a fluid ejecting apparatus according to an aspect of the invention described above, it is preferable that the diameter of the driven roller should gradually increase from the center part thereof to each end part thereof along the second direction. With such a preferred configuration, since the diameter of the driven roller gradually increases from the center part thereof to each end part thereof along the second direction, a gradual curve is formed in the medium. Since the medium is curved gradually, it is possible to prevent a crease, a small fold, or any other similar damage due to the folding thereof from being formed in a regional part of the medium that is in contact with the driven roller.

In the preferred configuration of a fluid ejecting apparatus described above, it is further preferable that the driven roller should have a curved roller face from the center part thereof to each end part thereof along the second direction. With such a preferred configuration, since the driven roller has a curved roller face from the center part thereof to each end part thereof along the second direction, the regional part of a fluid ejection target medium that is in contact with the driven roller also forms a curved sheet face. Thus, it is possible to prevent a crease, a small fold, or any other similar damage due to the folding thereof from being formed in the regional part of the medium that is in contact with the driven roller with greater reliability.

In the configuration of a fluid ejecting apparatus according to an aspect of the invention described above, it is preferable that the driven roller should be provided at a position that is shifted toward the supporting member when viewed in plan from the position of the driving roller. With such a preferred configuration, since the driven roller is provided at a position that is shifted toward the supporting member when viewed in plan from the position of the driving roller, it is possible to urge a fluid ejection target medium onto the supporting member when the medium is held between the driving roller and the driven roller. By this means, it is possible to make the fluid ejection target medium supported stably on the supporting member in a reliable manner.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to the accompanying drawings, an exemplary embodiment of the invention will now be explained in detail. In the following description of an exemplary embodiment of the invention, an ink-jet printer is taken as an example of a variety of fluid ejecting apparatuses according to various aspects of the invention. It should be noted that different scales are used for members, parts, components, and the like illustrated in each of the accompanying drawings that are referred to in the following explanation given in this specification so that each of the members, parts, components, and the like illustrated therein has a size that is easily recognizable.

Figure 1:
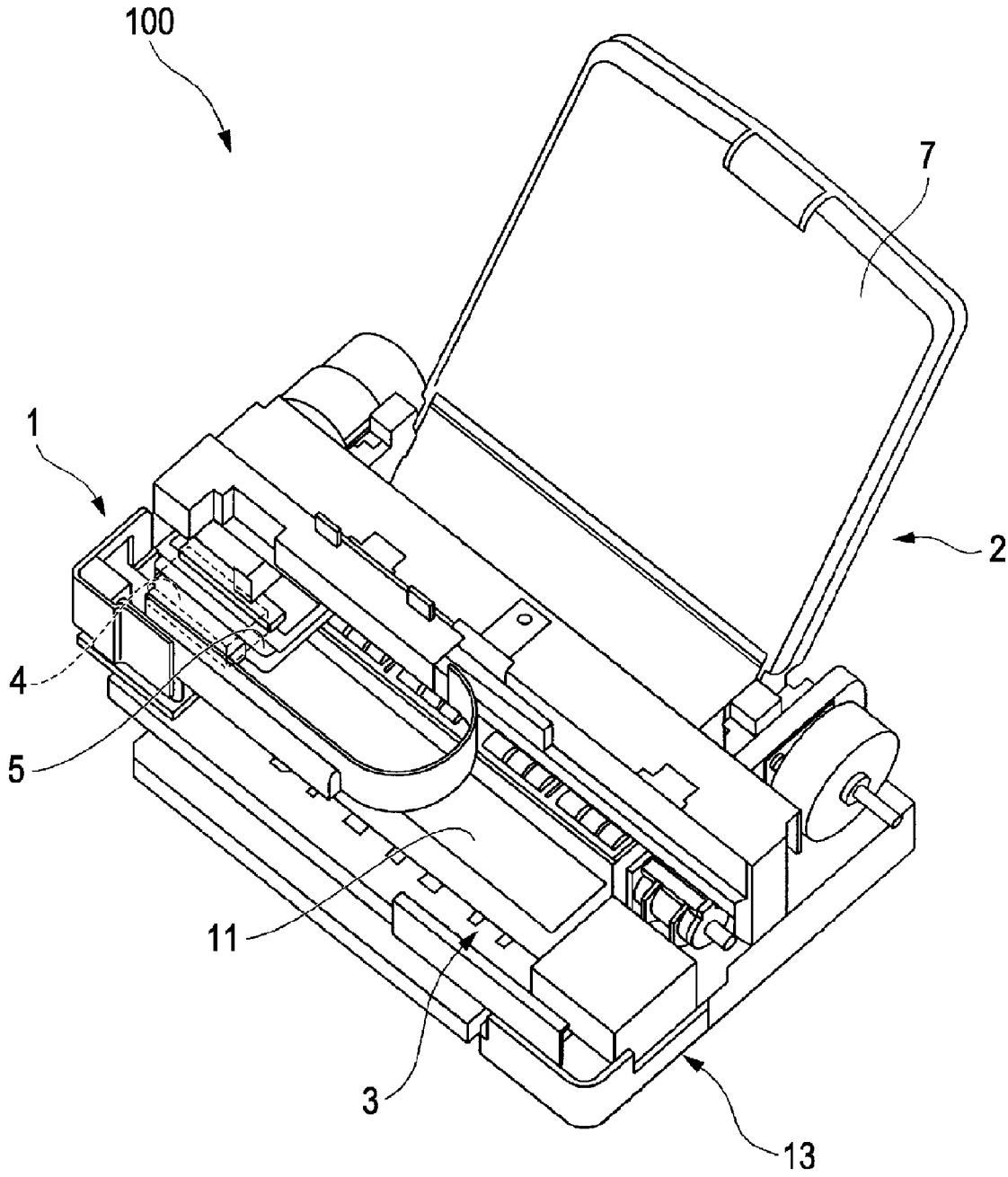
FIG. 1 is a perspective view that schematically illustrates an example of the configuration of an ink-jet printer according to an exemplary embodiment of the invention.
Figure 2:
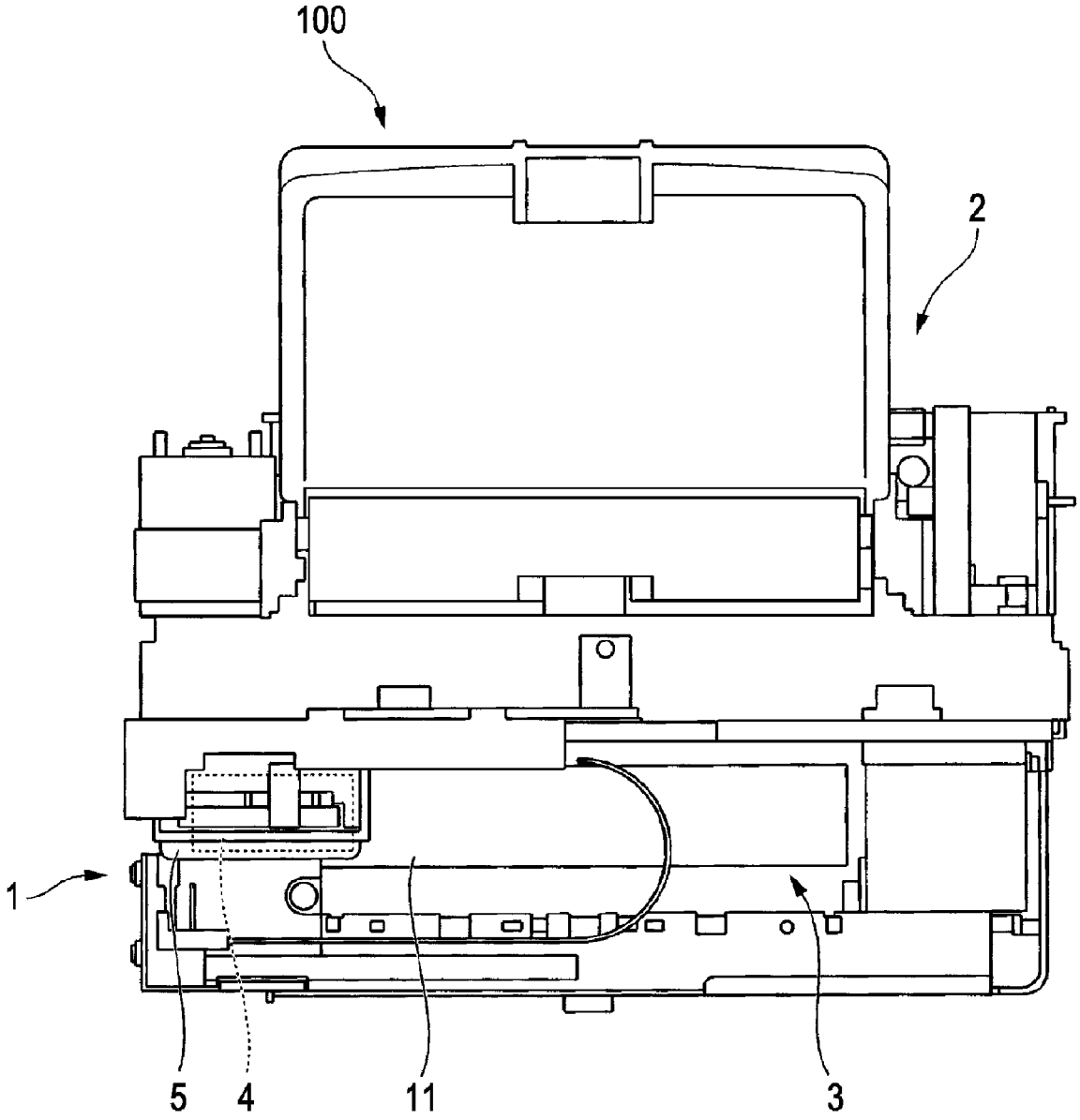
FIG. 2 is a plan view that schematically illustrates an example of the configuration of an ink-jet printer according to an exemplary embodiment of the invention.
Figure 3:
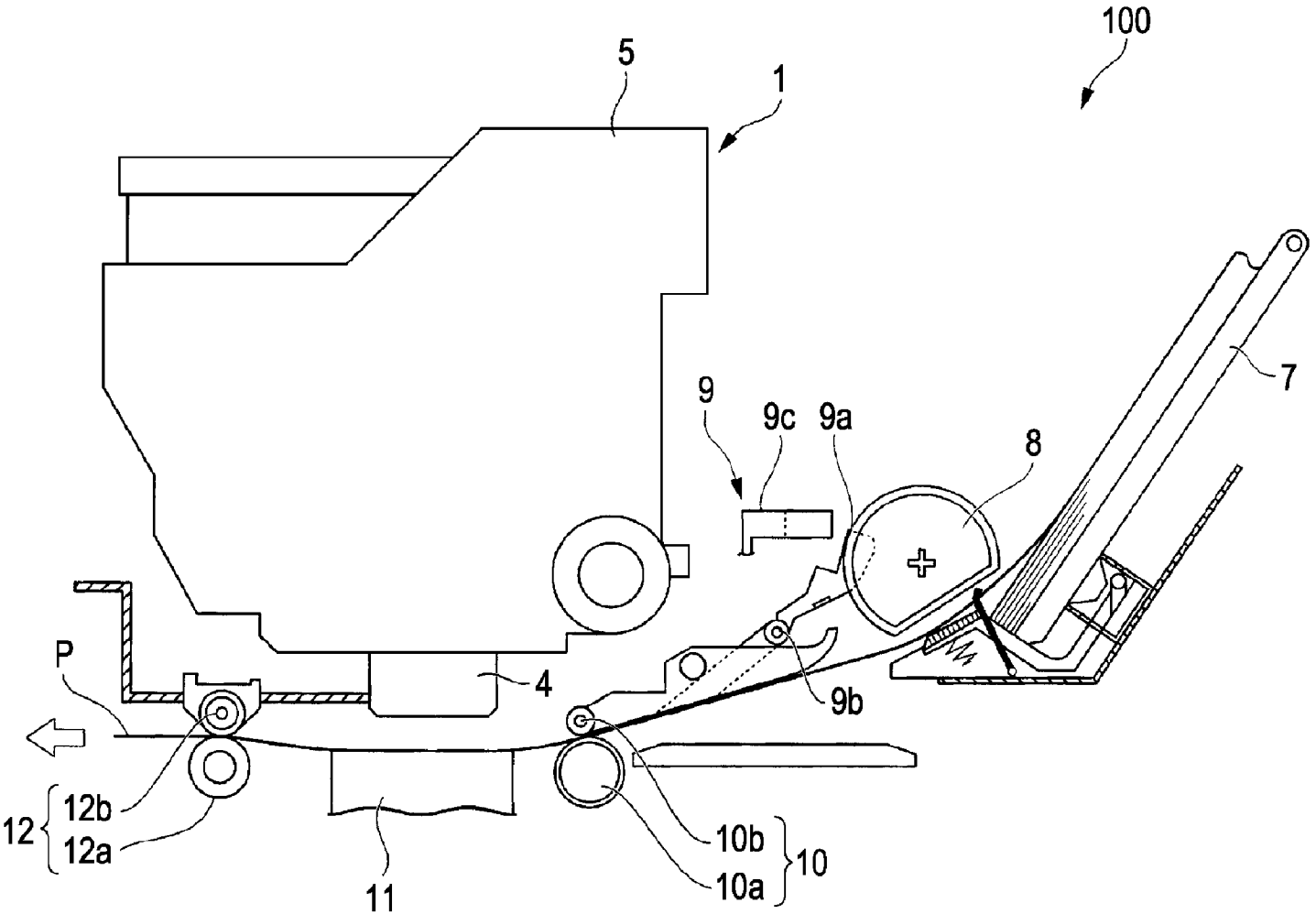
FIG. 3 is a sectional view that schematically illustrates an example of the configuration of an ink-jet printer according to an exemplary embodiment of the invention.
Figure 4:
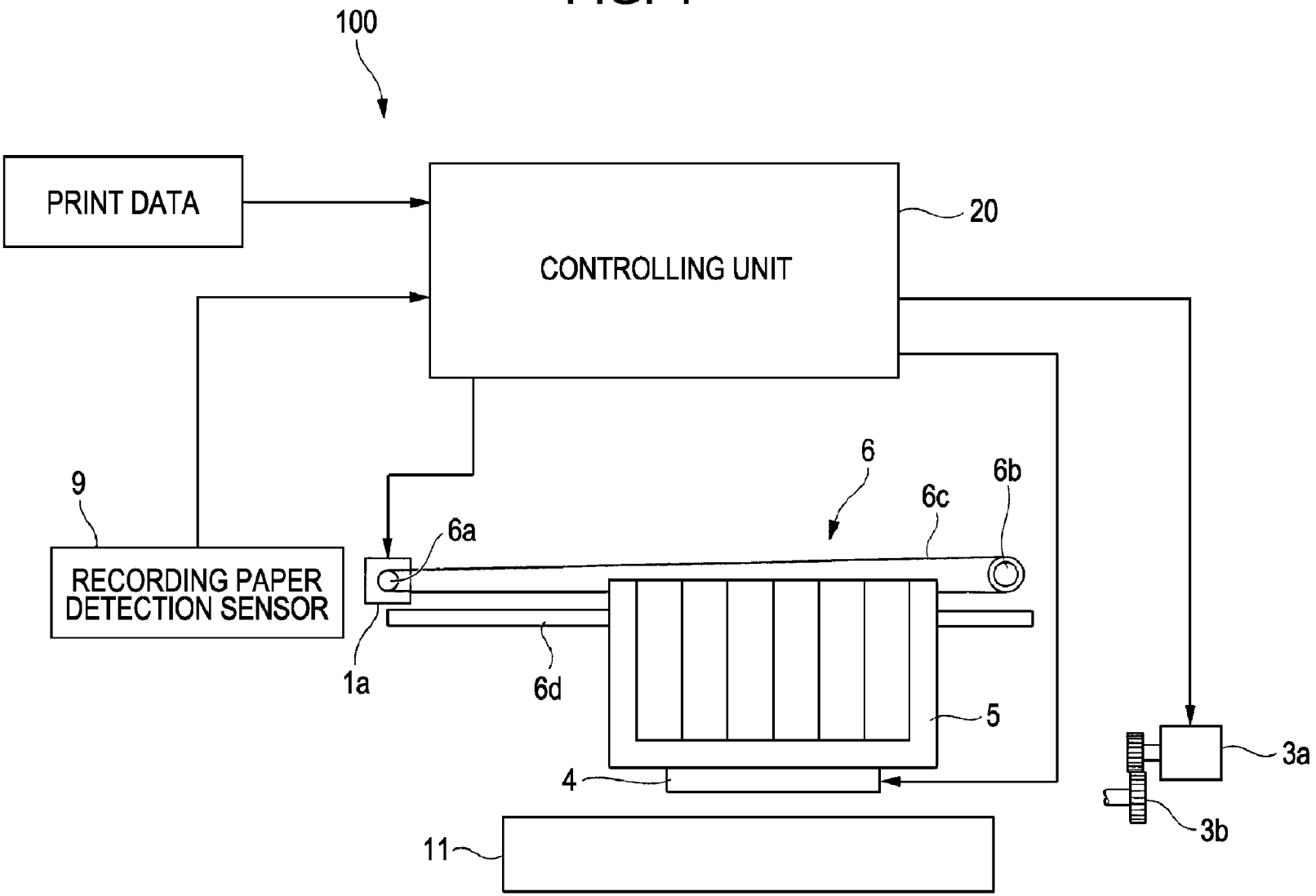
FIG. 4 is a diagram that schematically illustrates an example of the electric-connection configuration of an ink-jet printer according to an exemplary embodiment of the invention.

FIG. 1 is a perspective view that schematically illustrates an example of the inner configuration of an ink-jet printer 100 according to the present embodiment of the invention. FIG. 2 is a plan view that schematically illustrates an example of the inner configuration of the ink-jet printer 100. FIG. 3 is a sectional view that schematically illustrates an example of the inner configuration of the ink-jet printer 100. Specifically, FIG. 3 shows a cross section thereof taken along the direction of the transportation of a sheet of recording paper P. FIG. 4 is a diagram that schematically illustrates an example of the electric-connection configuration of the ink-jet printer 100.

As illustrated in these drawings, the ink-jet printer 100 is provided with a carriage unit 1, a paper-feed unit 2, and a paper-transport unit 3. In the configuration of the ink-jet printer 100, the paper-feed unit 2 and the paper-transport unit 3 are attached to the carriage unit 1 so that these units 1, 2, and 3 constitute a single integrated printer component.

The carriage unit 1 is a unit that ejects ink (which is an example of various kinds of fluids; the same denotation applies hereunder) onto the surface of a sheet of recording paper P, which is an example of various kinds of fluid ejection target media, thereby carrying out printing (recording) on the recording paper P. The carriage unit 1 includes a recording head (ejecting head) 4, a carriage 5, and a carriage-driving mechanism 6. The recording head 4 ejects ink onto the surface of a sheet of recording paper P. The carriage 5 is a movable member to which the recording head 4 is fixed. The carriage driver 6 applies a moving force to the carriage 5 so that the carriage 5 travels in a horizontal direction (main scan direction) that is orthogonal to the direction of the transportation (sub scan direction) of a sheet of recording paper P. The carriage driver 6 is illustrated in FIG. 4.

The recording head 4 is provided with a plurality of nozzles from each of which ink is ejected. Ink-ejection driving elements such as, for example, piezoelectric elements are provided inside the recording head 4. Through the functioning of the driving elements, the recording head 4 ejects ink through the nozzles thereof. Ink cartridges that are not shown in the drawings are attached to the carriage 5. Ink is supplied from the ink cartridges to the recording head 4.

The carriage-driving mechanism 6 includes a master driving pulley 6*a*, a slave driven pulley 6*b*, an endless belt 6*c*, and a carriage shaft 6*d*. The endless belt 6*c* is wound around the master driving pulley 6*a* at one "end" and the slave driven pulley 6*b* at the other end so as to be stretched therebetween. The carriage 5 is fixed to a part of the endless belt 6*c*. The carriage shaft 6*d* functions as a guiding axis along which the carriage 5 moves while being supported thereby. The carriage-driving mechanism 6 operates as follows. When a driving force is applied to the driving pulley 6*a* for the rotation thereof, the endless belt 6*c* moves. As the endless belt 6*c* moves, the carriage 5, which is fixed to a part of the endless belt 6*c*, moves together therewith in the main scan direction while being guided along the carriage shaft 6*d*.

The carriage unit 1 is provided with a carriage motor 1*a*, which is illustrated in FIG. 4. The ink-jet printer 100 according to the present embodiment of the invention is configured in such a manner that the carriage motor 1*a* supplies the driving force to the driving pulley 6*a*.

The paper-feed unit 2 is a unit that feeds sheets of recording paper P to the carriage unit 1. As illustrated in FIG. 3, the paper-feed unit 2 is provided with a paper-feed cassette 7, a paper-feed roller 8, and a recording paper detection sensor 9. A plurality of sheets of recording paper P that is waiting to be processed for recording can be stacked on the paper-feed cassette 7. The paper-feed roller 8 picks up the uppermost one of the plurality of sheets of recording paper P that is stacked on the paper-feed cassette 7 when double feeding does not occur. The paper pickup operation can be performed for the plurality of sheets of recording paper P that is set on the paper-feed cassette 7 one after another. The recording paper detection sensor 9 detects a sheet of recording paper P that has been fed by the paper pickup roller 8.

The paper-feed cassette 7 is provided in a slanted position. Specifically, the paper-feed cassette 7 is attached to the body of the ink-jet printer 100 in such a manner that the paper-feed cassette protrudes in an obliquely backward and upward direction. Since the paper-feed cassette 7 is in such an inclined position, sheets of recording paper P are also set thereon in an inclined paper position.

As illustrated in FIG. 3, the paper-feed roller 8 is a driving roller that has a chord part in a cross sectional view taken along the direction of the rotation thereof. The paper-feed roller 8 picks up a sheet of recording paper P by using frictional contact between the circumferential surface thereof at which the chord part thereof is not formed and the surface of the sheet of recording paper P. The ink-jet printer 100 according to the present embodiment of the invention is configured in such a manner that a driving motor power is transmitted from a paper-transport motor 3*a* of the paper-transport unit 3, which will be explained later, to the paper-feed roller 8 via a power transmission gear.

The recording paper detection sensor 9 includes a detection lever 9*a*, a rotation shaft 9*b*, and a sensor body part 9*c*. The sensor body part 9*c* is supported in such a manner that it can turn around the rotation shaft 9*b*. The recording paper detection sensor 9 further includes a light reception part that receives a beam of light that has been emitted from a light emission part. The light reception part of the recording paper detection sensor 9 is provided over the detection lever 9*a*. Note that the light reception part and the light emission part are not illustrated in the drawing. When a sheet of recording paper P passes therethrough, the detection lever 9*a* turns in an upward direction as it is forced up. As a result of the upward turning of the detection lever 9*a*, the light reception part photo-detects a beam of light propagating from the light emission part. Then, the detection lever 9*a* turns downward so as to return to its original position when, for example, the passing of the sheet of recording paper P has completed. As a result of the downward turning of the detection lever 9*a*, a beam of light that was emitted from the light emission part and propagates toward the light reception part is shut off on the way. The recording paper detection sensor 9 controls the shutoff/passing of a beam of light that was emitted from the light emission part and propagates toward the light reception part through the turning operation of the detection lever 9*a* as explained above. By this means, the recording paper detection sensor 9 detects the presence/absence of a sheet of recording paper P on the basis of the detection/non-detection of a beam of light at the light reception part provided on the detection lever 9*a*.

The paper-transport unit 3 is a unit that transports a sheet of recording paper P that has been fed thereto by the paper-feed unit 2. The paper-transport unit 3 includes a pair of paper-feed rollers 10, a platen 11, and a pair of paper-eject rollers 12. The pair of paper-feed rollers 10 transports a sheet of recording paper P that has now passed through the recording paper detection sensor 9 of the paper-feed unit 2. The platen 11, which is provided immediately under a sheet transportation path, supports the back of a sheet of recording paper P that has now passed through the pair of paper-feed rollers 10. The pair of paper-eject rollers 12 transports a sheet of recording paper P that has now passed through the platen 11 for the ejection thereof.

The pair of paper-feed rollers 10 is made up of a master paper-feeding roller 10*a* and a slave driven roller 10*b*. A driving force is applied to the master paper-feeding roller 10*a* for the rotation thereof. A nip is formed between the master paper-feeding roller 10*a* and the slave driven roller 10*b*. A sheet of recording paper P that is transported by the pair of paper-feed rollers 10 is pinched at the nip between the master paper-feeding roller 10*a* and the slave driven roller 10*b* during the paper-transport operation.

The platen 11 is provided under/below the carriage 5 of the carriage unit 1 at an area that corresponds to the movable area range of the carriage 5. The recording head 4 that is fixed to the lower surface of the carriage 5 ejects ink onto a sheet of recording paper P that is now being transported over the platen 11.

The pair of paper-eject rollers 12 is made up of a master paper-ejecting roller 12*a* and a slave driven roller 12*b*. A driving force is applied to the master paper-ejecting roller 12*a* for the rotation thereof. The pair of paper-eject rollers 12 transports a sheet of recording paper P so as to eject the sheet P while pinching the sheet P at a nip that is formed between the master paper-ejecting roller 12*a* and the slave driven roller 12*b* during the paper-transport operation.

The paper-transport unit 3 is provided with the aforementioned paper-transport motor 3*a*, which is illustrated in FIG. 4. A driving motor power outputted from the paper-transport motor 3*a* is transmitted to the master paper-feeding roller 10*a* and the master paper-ejecting roller 12*a* through a power transmission gear 3*b*.

As illustrated in FIGS. 1 and 2, the ink-jet printer 100 according to the present embodiment of the invention is further provided with a maintenance device 13 for the maintenance of the recording head 4. The maintenance device 13 is provided for the purpose of performing various kinds of maintenance operations on the recording head 4, which include but not limited to flushing operation, suction operation, wiping operation, and capping operation. The maintenance device 13 is provided at one end region of the ink-jet printer 100 when viewed in the direction of the scanning operation of the carriage 5.

As illustrated in FIG. 4, the ink-jet printer 100 according to the present embodiment of the invention is provided with a controlling unit 20. The controlling unit 20 controls the entire operation of the ink-jet printer 100 according to the present embodiment of the invention. The controlling unit 20 is electrically connected to the carriage unit 1, the paper-feed unit 2, the paper-transport unit 3, the maintenance device 13, and the like.

The controlling unit 20 includes an arithmetic processing unit such as a CPU or the like and a memory unit such as a ROM, a RAM, and the like. For example, on the basis of print data that is supplied from an external data supply source, the controlling unit 20 controls the operation of the recording head 4, the carriage motor 1*a*, and the paper-transport motor 3*a*.

Figure 5:
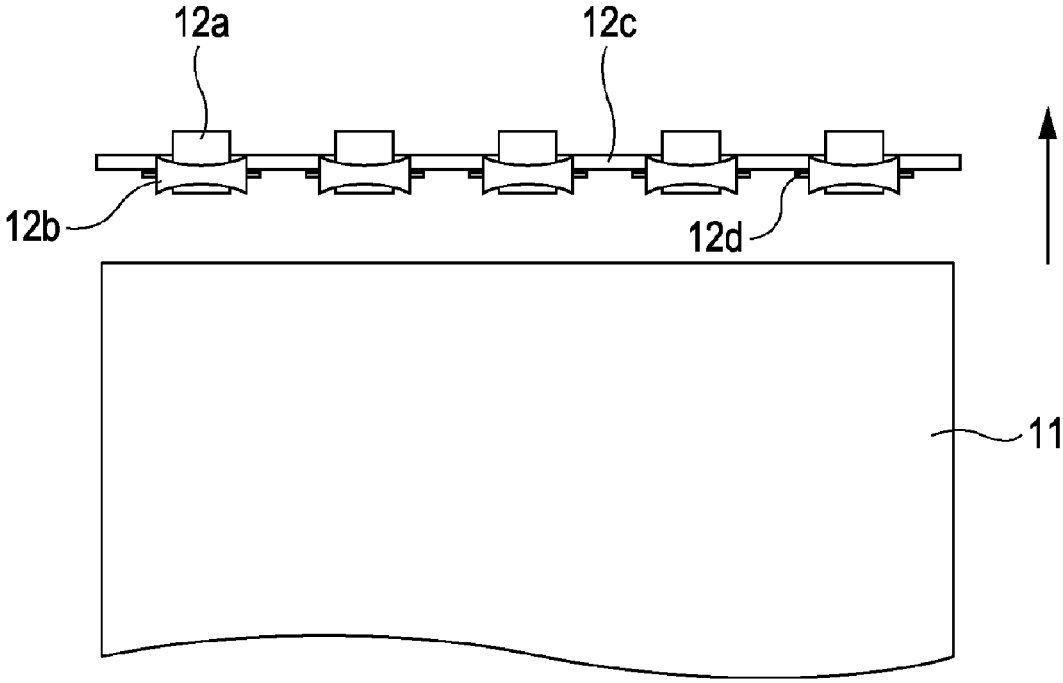
FIG. 5 is a plan view that schematically illustrates an example of the configuration of a platen and pairs of paper-eject rollers of an ink-jet printer according to an exemplary embodiment of the invention.

FIG. 5 is a plan view that schematically illustrates an example of the configuration of the platen 11 and the pairs of paper-eject rollers 12 according to the present embodiment of the invention. In FIG. 5, the paper transportation direction in which a sheet of recording paper P is transported is shown as the vertical direction. That is, a sheet of recording paper P is transported in the direction shown by an arrow, which is oriented toward the upper part of the figure. In the following description of this specification, the direction of the transportation of a sheet of recording paper P may be referred to as a first direction. In addition, the direction that is orthogonal to the direction of the transportation of a sheet of recording paper P (i.e., first direction) may be referred to as a second direction. The second direction corresponds to the horizontal direction in the drawing.

As illustrated in FIG. 5, a plurality of pairs of paper-eject rollers 12, for example, five pairs of paper-eject rollers 12 are arrayed adjacent to one another on a straight line at substantially regular intervals. The master paper-ejecting roller 12*a* of each pair of paper-eject rollers 12 is supported on a single common rotation shaft 12*c*. When the common rotation shaft 12*c* turns, each of the master paper-ejecting rollers 12*a* of all pairs of paper-eject rollers 12 turns at the same time. The slave driven roller 12*b* is made of an elastic material such as rubber or the like. A fluorine coat layer is formed on the surface of the slave driven roller 12*b*. Each slave driven roller 12*b* of the plurality of pairs of paper-eject rollers 12 has an individual rotation shaft 12*d*, which is not shared among the plurality of slave driven rollers 12*b*. The rotation shafts 12*d* of the slave driven rollers 12*b* are in alignment with one another. The straight line on which the rotation shafts 12*d* of the slave driven rollers 12*b* are arrayed extends in the second direction.

Each individual rotation shaft 12*d* of the plurality of the slave driven rollers 12*b* is provided at a position that is shifted toward the platen 11 when viewed in plan from the position of the common rotation shaft 12*c* of the plurality of the master paper-ejecting rollers 12*a*. Or, in other words, the slave driven roller 12*b* is provided at a relatively upstream position when viewed in plan along the direction of the transportation of a sheet of recording paper P. Because of such a shifted shaft layout, a sheet of recording paper P takes a slanted position, which is inclined toward the platen 11, when the sheet P passes through a nip that is formed between the master paper-ejecting roller 12*a* and the slave driven roller 12*b*.

Figure 6:
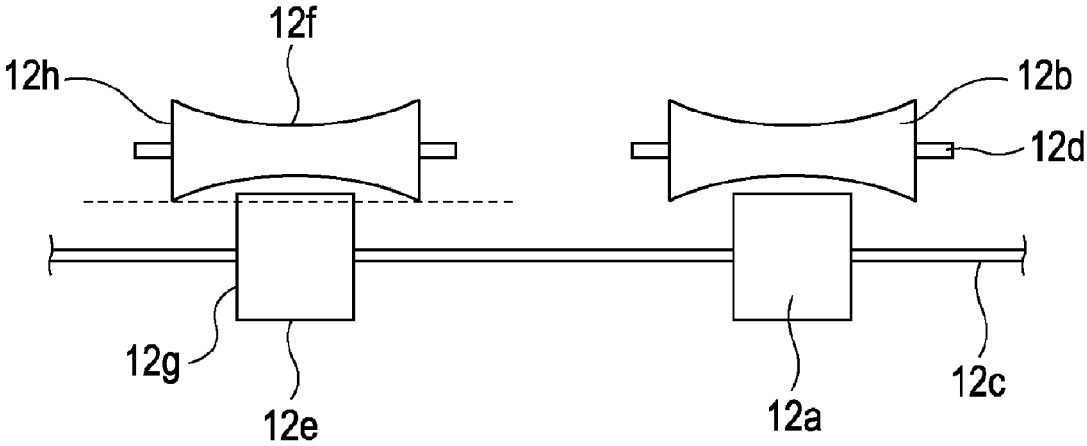
FIG. 6 is a diagram that schematically illustrates an example of the configuration of a plurality of paper-eject rollers of an ink-jet printer according to an exemplary embodiment of the invention.

FIG. 6 is a diagram that schematically illustrates an example of the configuration of the plurality of pairs of paper-eject rollers 12 when viewed along the direction of the transportation of a sheet of recording paper P. The direction from the proximal/near side as viewed with respect to the drawing sheet face of FIG. 6 toward the distal/far side as viewed with respect to the drawing sheet face thereof corresponds to the first direction defined above. The horizontal direction of FIG. 6 corresponds to the second direction defined above. Accordingly, in the following explanation given with reference to FIG. 6, the direction from the proximal/near side as viewed with respect to the drawing sheet face thereof toward the distal/far side as viewed with respect to the drawing sheet face thereof may be referred to as the first direction. The horizontal direction of FIG. 6 may be referred to as the second direction.

As illustrated in the drawing, the slave driven roller 12*b* protrudes outward in such a manner that the end part 12*h* provided at each side of the slave driven roller 12*b* when viewed in the second direction lies at a relatively outside end position in comparison with the end position of the end part 12*g* provided at each side of the master paper-ejecting roller 12*a* when viewed in the second direction. In addition, the diameter of the protruding part of the slave driven roller 12*b* is larger than that of the other non-protruding part thereof. For example, the diameter of the protruding part of the slave driven roller 12*b* is larger than that of the center part thereof, where the center is defined herein as a part of the other non-protruding part when viewed in the second direction.

The slave driven roller 12*b* has a curved roller shape. Specifically, the diameter of the slave driven roller 12*b* gradually increases from the center part thereof to each end part 12*h* thereof along the second direction. In addition, the slave driven roller 12*b* and the master paper-ejecting roller 12*a* are provided at such relative positions that a part of the slave driven roller 12*b* overlaps a part of the master paper-ejecting roller 12*a* when viewed along the second direction.

Next, an explanation is given below of the operation of the ink-jet printer 100 according to the present embodiment of the invention, which has an exemplary configuration explained above. The controlling unit 20 functions as a main and central unit that controls the operation of the ink-jet printer 100 explained below. As a preparatory step, a plurality of sheets of recording paper P is stacked on the paper-feed cassette 7 of the paper-feed unit 2. The controlling unit 20 instructs that the paper-feed roller 8 of the paper-feed unit 2 should be driven. As a result, the paper-feed roller 8 is rotated. When the paper-feed roller 8 turns, the uppermost one of the sheets of recording paper P that are stacked on the paper-feed cassette 7 is picked up for the feeding thereof.

The sheet of recording paper P that has been picked up for the feeding thereof because of the turning operation of the paper-feed roller 8 passes through the recording paper detection sensor 9. At the time when the sheet of recording paper P passes the recording paper detection sensor 9, the recording paper detection sensor 9 detects the presence of the sheet P. Then, the recording paper detection sensor 9 supplies the result of detection to the controlling unit 20 as an input. Having passed through the recording paper detection sensor 9, the sheet of recording paper P is transported onto the platen 11 by the pair of paper-feed rollers 10 of the paper-transport unit 3.

As the turning operation of the pair of paper-feed rollers 10 is continued, the sheet of recording paper P that is now being transported reaches the center area over the platen 11 as viewed in the sheet transportation direction. The controlling unit 20 commands the recording head 4 of the carriage unit 1 to eject ink onto the sheet of recording paper P thereat. Specifically, the controlling unit 20 commands the carriage 5, which supports the recording head 4, to move in the main scan direction and further commands the recording head 4 to perform ink ejection while being moved together with the carriage 5. On the basis of the result of detection performed by the recording paper detection sensor 9 and further on the basis of print data, though not limited thereto, the controlling unit 20 controls the timing of ink ejection at the time when the recording head 4 ejects ink so that the ejected ink drops should land at desired positions on the surface of the sheet of recording paper P.

Figure 7:
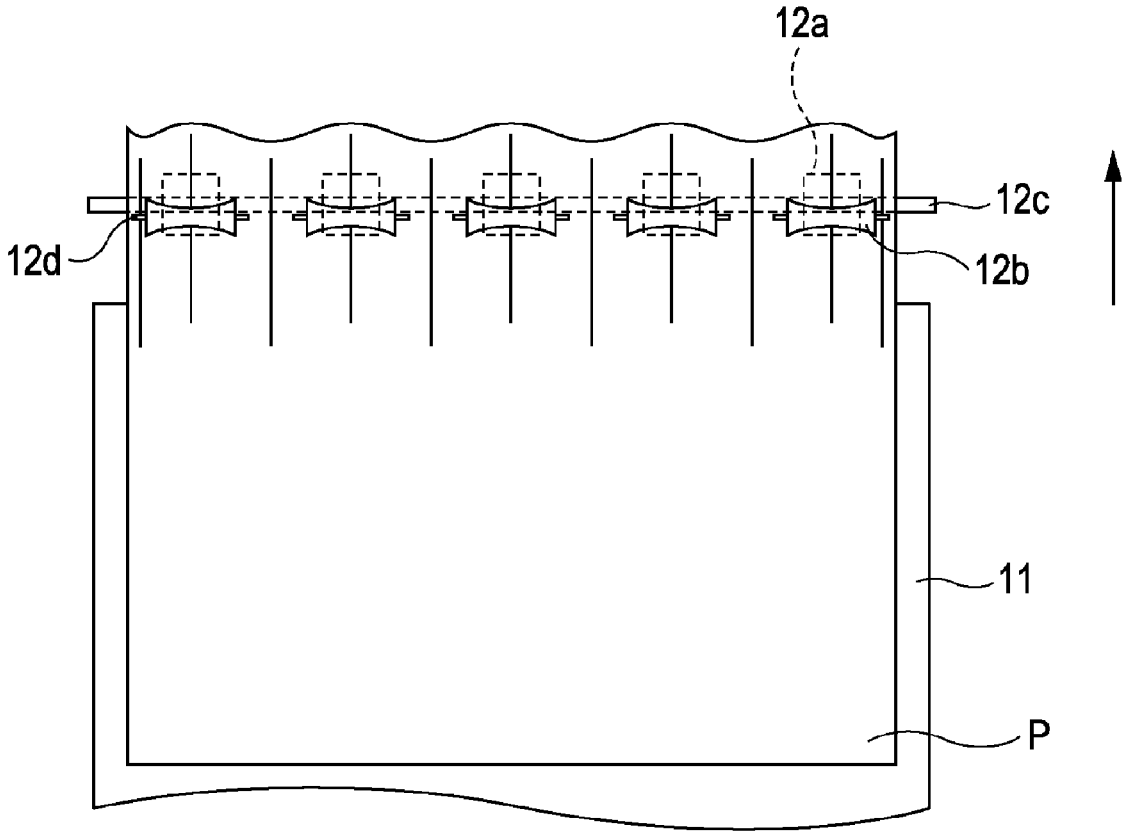
FIG. 7 is a diagram that schematically illustrates an example of the operation of an ink-jet printer according to an exemplary embodiment of the invention.
Figure 8:
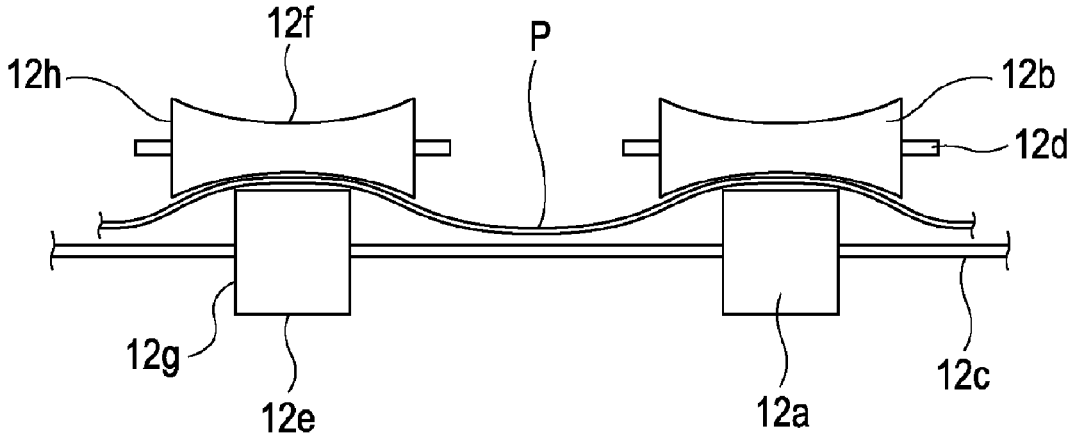
FIG. 8 is a diagram that schematically illustrates an example of the operation of an ink-jet printer according to an exemplary embodiment of the invention.

After the front edge of the sheet of recording paper P has reached the pair of paper-eject rollers 12, the sheet P is transported while being held by both of the pair of paper-eject rollers 12 and the pair of paper-feed rollers 10. FIG. 7 is a plan view that schematically illustrates an example of a paper-held state in which the pair of paper-eject rollers 12 holds a sheet of recording paper P. The same viewpoint, or the same viewing direction, as that of FIG. 5 is taken in FIG. 7. FIG. 8 is a sectional view that schematically illustrates an example of the paper-held state mentioned above. The same viewpoint, or the same viewing direction, as that of FIG. 6 is taken in FIG. 8.

The pair of paper-eject rollers 12 holds a sheet of recording paper P by pinching the sheet P at a nip that is formed between the master paper-ejecting roller 12*a* and the slave driven roller 12*b* during the paper-transport operation. When a sheet of recording paper P is pinched therebetween, as illustrated in FIGS. 7 and 8, the surfaces of the sheet P are in contact with the surface 12*e* of the master paper-ejecting roller 12*a* and the surface 12*f* of the slave driven roller 12*b*, respectively. Accordingly, the sheet of recording paper P is put into a curved form along the surface 12*f* of the slave driven roller 12*b*.

As illustrated in FIGS. 7 and 8, the sheet of recording paper P is regionally curved at each of five pairs of paper-eject rollers 12. The regional part of the sheet of recording paper P that is held by each pair of paper-eject rollers 12 and the neighborhood part thereof is curved so that, when viewed as a whole in the second direction, the sheet P has a corrugated shape. Since the slave driven roller 12*b* is provided at a shifted position that is behind the master paper-ejecting roller 12*a*, that is, at a relatively upstream position when viewed in the first direction, the sheet of recording paper P is urged onto the platen 11 when the sheet P is in a held state, that is, when pinched by the pair of paper-eject rollers 12.

In addition, when the platen 11 supports the sheet of recording paper P, the part of the sheet P that is urged onto the platen 11 is in a flat state without being curved. The controlling unit 20 causes the master paper-ejecting roller 12*a* to turn when the sheet of recording paper P is in such a state. As the master paper-ejecting roller 12*a* turns, friction occurs at the contact region between the master paper-ejecting roller 12*a* and the sheet of recording paper P. As a result, the sheet P is transported in the first direction due to the friction.

As explained in detail above, in the configuration of the ink-jet printer 100 according to the present embodiment of the invention, the pair of paper-eject rollers 12, which transports a sheet of recording paper P in the first direction while holding the sheet P, includes the master paper-ejecting roller 12*a* that is provided at the platen (11) side and is in contact with the sheet P from the platen (11) side when the pair of paper-eject rollers 12 holds the sheet P, and the slave driven roller 12*b* that is provided at the recording-head (4) side and is in contact with the sheet P from the recording-head (4) side when the pair of paper-eject rollers 12 holds the sheet P. In such a configuration of the ink-jet printer 100 according to the present embodiment of the invention, the slave driven roller 12*b* protrudes outward in such a manner that the end part 12*h* provided at each side of the slave driven roller 12*b* when viewed in the second direction lies at a relatively outside end position in comparison with the end position of the end part 12*g* provided at each side of the master paper-ejecting roller 12*a* when viewed in the second direction. In addition, the diameter of the protruding part of the slave driven roller 12*b* is larger than that of the other non-protruding part thereof. Since the ink-jet printer 100 according to the present embodiment of the invention has the configuration explained above, the sheet of recording paper P that is held by the pair of paper-eject rollers 12 is put into a curved form along the surface 12*f* of the slave driven roller 12*b*. Since the sheet of recording paper P is put into a curved form, it is possible to increase the stiffness of the paper P in the curve projection direction, which results in the enhanced shape stability of the sheet P in this direction. Thus, it is possible to make the sheet of recording paper P supported on the platen 11 in a stable manner.

In addition, since the plurality of pairs of paper-eject rollers 12 is arrayed in the second direction in the configuration of the ink-jet printer 100 according to the present embodiment of the invention, it is possible to form curves in a sheet of recording paper P so that the sheet P has a corrugated shape when viewed as a whole in the second direction. The plurality of curves makes it possible to further increase the stiffness of the sheet of recording paper P, thereby enhancing the shape stability of the sheet P.

Moreover, in the configuration of the ink-jet printer 100 according to the present embodiment of the invention, the plurality of pairs of paper-eject rollers 12 is arrayed at substantially regular intervals. With such a structure, it is possible to form the plurality of curves in a sheet of recording paper P at substantially regular intervals when viewed in the second direction. Therefore, it is possible to achieve a uniform increase in the stiffness of the sheet of recording paper P along the second direction. Furthermore, in the configuration of the ink-jet printer 100 according to the present embodiment of the invention, the slave driven roller 12*b* and the master paper-ejecting roller 12*a* are provided at such relative positions that a part of the slave driven roller 12*b* overlaps a part of the master paper-ejecting roller 12*a* when viewed along the second direction. With such a structure, it is possible to form larger curves in a sheet of recording paper P.

In addition, in the configuration of the ink-jet printer 100 according to the present embodiment of the invention, the diameter of the slave driven roller 12*b* gradually increases from the center part thereof to each end part 12*h* thereof along the second direction. With such a structure, it is possible to prevent a crease, a small fold, or any other similar damage due to the folding thereof from being formed in a regional part of a sheet of recording paper P that is in contact with the slave driven roller 12*b*. Moreover, since the slave driven roller 12*b* has a curved roller face from the center part thereof to each end part 12*h* thereof along the second direction, the regional part of a sheet of recording paper P that is in contact with the slave driven roller 12*b* also forms a curved sheet face. Thus, it is possible to prevent a crease, a small fold, or any other similar damage due to the folding thereof from being formed in a regional part of a sheet of recording paper P that is in contact with the slave driven roller 12*b* with greater reliability.

Furthermore, in the configuration of the ink-jet printer 100 according to the present embodiment of the invention, the slave driven roller 12*b* is provided at a position that is shifted toward the platen 11 when viewed in plan from the position of the master paper-ejecting roller 12*a*. With such a structure, it is possible to urge a sheet of recording paper P onto the platen 11 when the sheet P is held between the master paper-ejecting roller 12*a* and the slave driven roller 12*b*. Thus, it is possible to make the sheet of recording paper P supported on the platen 11 in a stable manner with greater reliability.

Although an exemplary embodiment of the present invention is described above, needless to say, the invention is in no case restricted to the exemplary embodiment described herein; the invention may be configured in an adaptable manner in a variety of variations and/or modifications without departing from the spirit thereof. For example, although it is described in the foregoing exemplary embodiment of the invention that the slave driven roller 12*b* has a curved roller shape and that the diameter of the slave driven roller 12*b* gradually increases from the center part thereof to each end part 12*h* thereof along the second direction, the scope of this aspect of the invention is not limited to such an exemplary configuration. As an example of the modified configuration thereof, each second-directional end part 12*h* of the slave driven roller 12*b* only may be formed as a projection whereas the other part of the slave driven roller 12*b* that is interposed between the end parts 12*h* thereof is formed as a flat part.

It is described in the foregoing exemplary embodiment of the invention that the slave driven roller 12*b* and the master paper-ejecting roller 12*a* are provided at such relative positions that a part of the slave driven roller 12*b* overlaps a part of the master paper-ejecting roller 12*a* when viewed along the second direction. However, the scope of this aspect of the invention is not limited to such an exemplary configuration. That is, for example, the slave driven roller 12*b* and the master paper-ejecting roller 12*a* may not overlap each other at all when viewed along the second direction as long as it is still possible to form a curve in a sheet of recording paper P.

It is described in the foregoing exemplary embodiment of the invention that the slave driven roller 12*b* is provided at a position that is shifted toward the platen 11 when viewed in plan from the position of the master paper-ejecting roller 12*a*. However, the scope of this aspect of the invention is not limited to such an exemplary configuration. For example, the master paper-ejecting roller 12*a* and the slave driven roller 12*b* may be provided in such a layout that, when viewed in plan, the common rotation shaft 12*c* and the individual rotation shaft 12*d* are in alignment with each other.

It is described in the foregoing exemplary embodiment of the invention that the plurality of pairs of paper-eject rollers 12 is arrayed at substantially regular intervals. However, the scope of this aspect of the invention is not limited to such an exemplary configuration. That is, the plurality of pairs of paper-eject rollers 12 may be arrayed at irregular intervals. For example, a relatively large number of the pairs of paper-eject rollers 12 may be arrayed at the center part of the platen 11 when viewed in the second direction with a relatively small number of the pairs of paper-eject rollers 12 being arrayed at the end part of the platen 11 when viewed in the second direction. Or, as a reversed modification example of the above modification example, a relatively small number of the pairs of paper-eject rollers 12 may be arrayed at the center part of the platen 11 when viewed in the second direction with a relatively large number of the pairs of paper-eject rollers 12 being arrayed at the end part of the platen 11 when viewed in the second direction.

It is described in the foregoing exemplary embodiment of the invention that each slave driven roller 12*b* of the plurality of pairs of paper-eject rollers 12 protrudes outward in such a manner that the end part 12*h* provided at each side of the slave driven roller 12*b* when viewed in the second direction lies at a relatively outside end position in comparison with the end position of the end part 12*g* provided at each side of the master paper-ejecting roller 12*a* thereof when viewed in the second direction. In addition, it is described in the foregoing exemplary embodiment of the invention that the diameter of the protruding part of each slave driven roller 12*b* of the plurality of pairs of paper-eject rollers 12 is larger than that of the other non-protruding part thereof. However, the scope of this aspect of the invention is not limited to such an exemplary configuration. For example, it may be not the slave driven rollers 12*b* of all of the plurality of pairs of paper-eject rollers 12 but the slave driven rollers 12*b* of some of the plurality of pairs of paper-eject rollers 12 that have the configuration explained above.

In the configuration of the ink-jet printer 100 according to the foregoing exemplary embodiment of the invention, it is explained that a fluid ejecting apparatus is embodied as an ink-jet recording apparatus. However, the scope of the invention is not limited to such an exemplary configuration. For example, the invention is applicable to a variety of fluid ejecting apparatuses that eject or discharge various kinds of fluid that includes ink but not limited thereto. For example, the scope of the invention covers, without any limitation thereto, a liquid ejecting apparatus that is provided with a liquid ejecting head that ejects liquid onto a liquid ejection target medium. The invention is further applicable to a fluid ejecting apparatus that ejects a liquid/liquefied matter/material that is made as a result of dispersion of particles of functional material(s) into/with liquid. The invention is further applicable to a fluid ejecting apparatus that ejects a gel substance. The invention is further applicable to a fluid ejecting apparatus that ejects other type of non-liquid fluid such as a (semi-) solid substance that can be ejected as a fluid. It should be noted that the scope of the invention is not limited to those enumerated above. In addition to an ink-jet printer described in the foregoing exemplary embodiment of the invention, a fluid ejecting apparatus to which the invention is applicable encompasses a wide variety of other types of apparatuses that ejects liquid or fluid in which, for example, a color material or an electrode material is dispersed or dissolved, though not necessarily limited thereto. Herein, the color material may be, for example, one that is used in the production of color filters for a liquid crystal display device or the like. The electrode material (i.e., conductive paste) may be, though not limited thereto, one that is used for electrode formation of an organic EL display device, a surface/plane emission display device (FED), and the like. A fluid ejecting apparatuses to which the invention is applicable further encompasses a wide variety of other types of apparatuses such as one that ejects a living organic material used for production of biochips or one that is provided with a sample ejection head functioning as a high precision pipette and ejects liquid as a sample therefrom. Further in addition, the invention is applicable to, and thus can be embodied as, a liquid ejecting apparatus that ejects, with high precision, lubricating oil onto a precision instrument and equipment including but not limited to a watch and a camera. Moreover, the invention is applicable to and thus can be embodied as a liquid ejecting apparatus that ejects liquid of a transparent resin such as an ultraviolet ray curing resin or the like onto a substrate so as to form a micro hemispherical lens (optical lens) that is used in an optical communication element or the like. Furthermore, the invention is applicable to and thus can be embodied as a liquid ejecting apparatus that ejects an etchant such as acid or alkali that is used for the etching of a substrate or the like. In addition, the invention is applicable to and thus can be embodied as a fluid ejecting apparatus that ejects a gel fluid. Moreover, the invention is applicable to and thus can be embodied as a dry-jet type (i.e., powder-ejecting type) recording apparatus that ejects various kinds of solid such as powder or a granular matter/material that includes toner, without any limitation thereto. Without any intention to limit the technical scope of the invention to those enumerated or explained above, the invention can be applied to a variety of ejecting apparatuses that eject or discharge various kinds of fluid, liquid, or the like such as those enumerated or explained above.

What is claimed is:

1. A fluid ejecting apparatus comprising:

a supporting member that supports a fluid ejection target medium;

a fluid ejecting head that is provided opposite to the supporting member so as to eject fluid toward the supporting member; and a medium ejecting section that ejects the medium in a first direction while holding the medium in such a manner that the medium is supported by the supporting member, the medium ejecting section including a driving roller that is provided at the supporting-member side and is in contact with the medium from the supporting-member side when the medium ejecting section holds the medium, and a driven roller that is provided at the fluid-ejecting-head side and is in contact with the medium from the fluid-ejecting-head side when the medium ejecting section holds the medium, wherein the driven roller protrudes outward in such a manner that an end part provided at each side of the driven roller when viewed in a second direction lies at a relatively outside end position in comparison with the end position of an end part provided at each side of the driving roller when viewed in the second direction; and the diameter of the protruding part of the driven roller is larger than that of the other part of the driven roller.

2. The fluid ejecting apparatus according to claim 1, wherein the driven roller and the driving roller are provided at such relative positions that at least a part of the driven roller overlaps at least a part of the driving roller when viewed along the second direction.

3. The fluid ejecting apparatus according to claim 1, wherein the medium ejecting section includes a plurality of sections that are arrayed in the second direction.

4. The fluid ejecting apparatus according to claim 3, wherein the plurality of medium ejecting sections is arrayed at substantially regular intervals.

5. The fluid ejecting apparatus according to claim 1, wherein the diameter of the driven roller gradually increases from the center part thereof to each end part thereof along the second direction.

6. The fluid ejecting apparatus according to claim 5, wherein the driven roller has a curved roller face from the center part thereof to each end part thereof along the second direction.

7. The fluid ejecting apparatus according to claim 1, wherein the driven roller is provided at a position that is shifted toward the supporting member when viewed in plan from the position of the driving roller.

* * * * *